US010308491B2

(12) United States Patent
Stent

(10) Patent No.: US 10,308,491 B2
(45) Date of Patent: Jun. 4, 2019

(54) SIDEPLATE FOR FORK CARRIAGE

(71) Applicant: Hyster-Yale Group, Inc., Fairview, OR (US)

(72) Inventor: Mark Stent, Basingstoke (GB)

(73) Assignee: HYSTER-YALE GROUP, INC., Fairview, OR (US)

( * ) Notice: Subject to any disclaimer, the term of this patent is extended or adjusted under 35 U.S.C. 154(b) by 224 days.

(21) Appl. No.: 15/480,715

(22) Filed: Apr. 6, 2017

(65) Prior Publication Data

US 2018/0141795 A1 May 24, 2018

Related U.S. Application Data

(63) Continuation-in-part of application No. 29/585,010, filed on Nov. 18, 2016, now Pat. No. Des. 813,140.

(51) Int. Cl.
*B66F 9/12* (2006.01)
*B66F 9/08* (2006.01)

(52) U.S. Cl.
CPC . *B66F 9/12* (2013.01); *B66F 9/08* (2013.01)

(58) Field of Classification Search
CPC .. B66F 9/075; B66F 9/08; B66F 9/122; B66F 9/125; B66F 9/14; B66F 9/146; B66F 9/147; B66F 9/16
See application file for complete search history.

(56) References Cited

U.S. PATENT DOCUMENTS 2,421,472 A * 6/1947 Way ..... B66F 9/06 37/405
3,061,045 A * 10/1962 Gunning ..... B66F 9/08 187/226
3,061,047 A * 10/1962 Gunning ..... B66F 9/08 187/226
3,083,853 A * 4/1963 Hastings, Jr. ..... B66F 9/08 414/629
5,145,034 A 9/1992 Miles
5,788,016 A * 8/1998 Soulas ..... B66F 9/16 187/238
D813,140 S * 3/2018 Stent ..... D12/223
2003/0221914 A1* 12/2003 Smith ..... B66F 9/122 187/244
2005/0186059 A1* 8/2005 Foroni ..... B66F 9/148 414/667

FOREIGN PATENT DOCUMENTS

DE 10018990 A1 10/2001

OTHER PUBLICATIONS

European Search Report; App. No. 17166055.8; dated Nov. 16, 2017, pp. 1-9.

* cited by examiner

*Primary Examiner* — Minh Truong
(74) *Attorney, Agent, or Firm* — Schwabe Williamson & Wyatt

(57) ABSTRACT

Shaped sideplates include a portion of the sideplate that is contained within a mast channel such that such portion is at least substantially hidden from the view of an operator located at the operator station of the forklift.

5 Claims, 3 Drawing Sheets

SIDEPLATE FOR FORK CARRIAGE

TECHNICAL FIELD

Fork carriages for forklift trucks.

BACKGROUND

A typical forklift carriage sideplate is illustrated in FIG. 1. Sideplate 1 includes rollers 4 that fit within mast channel 5 to enable the forklift carriage to be vertically movable. As shown in FIG. 1, sideplate 1 is a generally vertical element of a fork carriage.

SUMMARY

The present inventor has recognized that typical sideplates for forklift carriages are formed in a substantially linear manner for (1) ease of manufacturing and (2) load bearing capacity. The present inventor also recognized that sideplates may be shaped differently such that a portion of a sideplate is contained within a mast channel such that the portion is hidden from the view of an operator located at the operator station of the forklift. The present inventor also recognized that such shaped sideplates maintain an acceptable strength of the sideplate and do not substantially increase manufacturing difficulty. For example, such sideplates may be manufactured by casting, forging, additive manufacturing, welding, machining, or other suitable manner.

DETAILED DESCRIPTION

Figure 1:
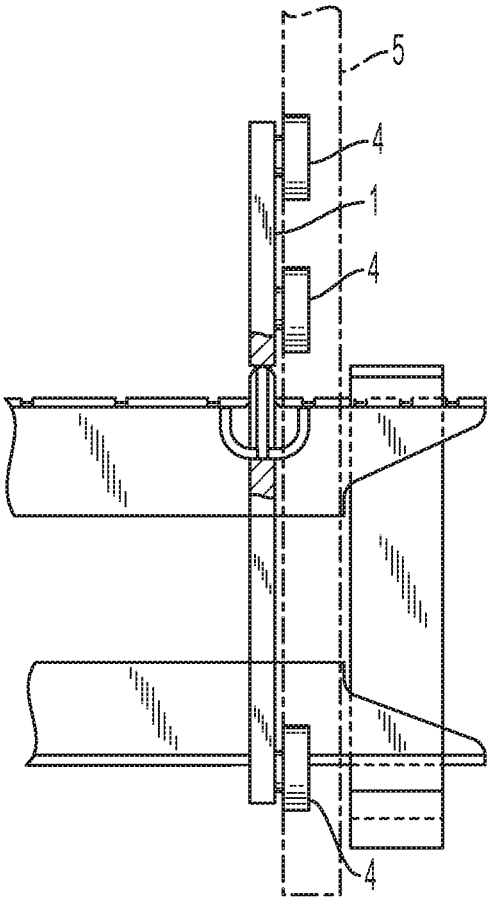
Fig. 1 (prior art)
FIG. 1 illustrates a prior art sideplate for a forklift carriage.
Figure 2:
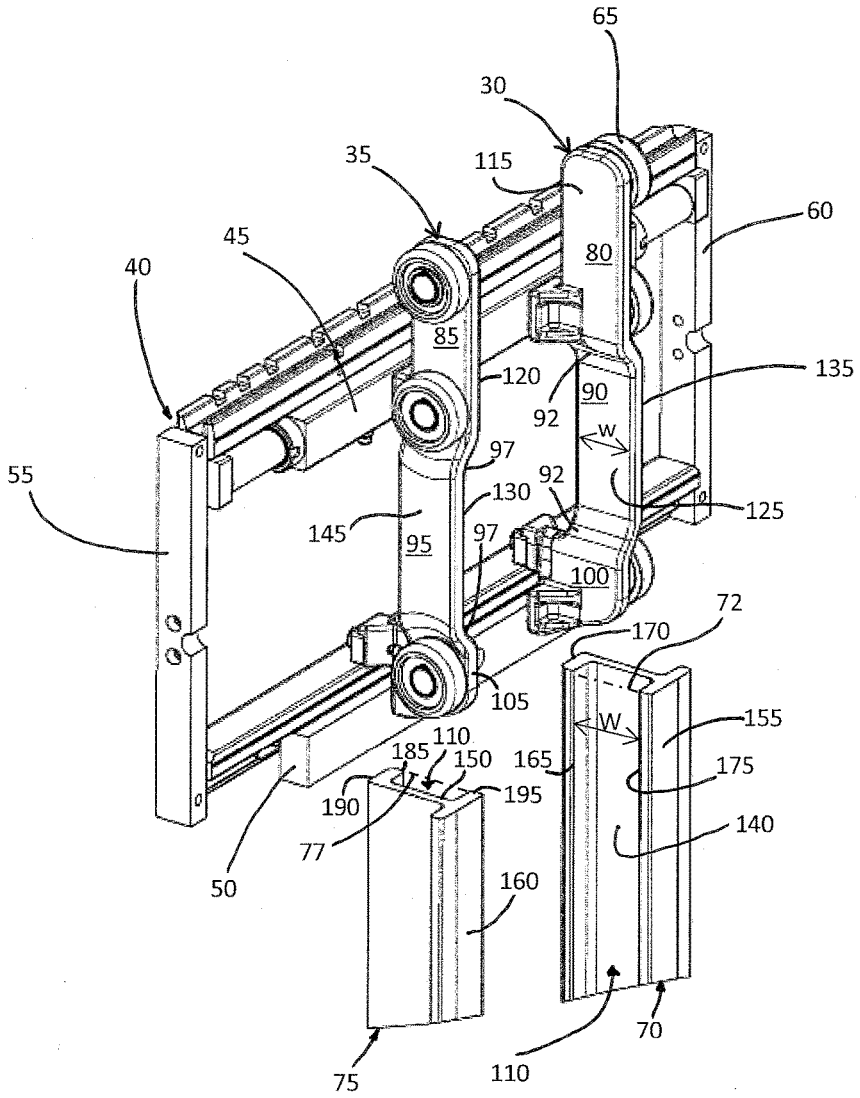
FIG. 2 illustrates an orthogonal, rear view of a forklift carriage with sideplates.
Figure 3:
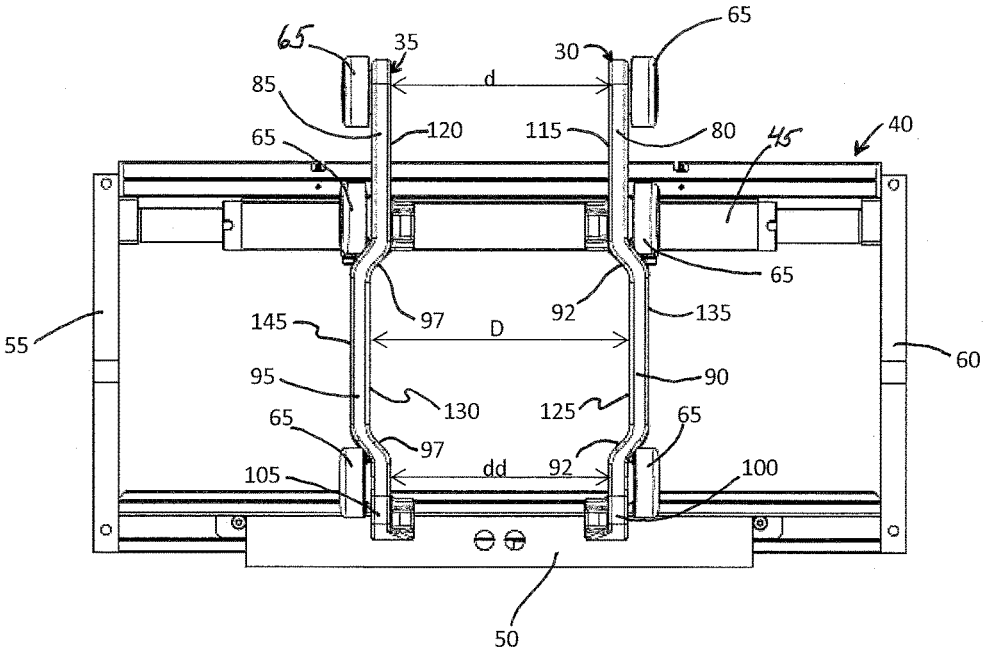
FIG. 3 illustrates a rear view of the carriage with sideplates of FIG. 2.

With reference to FIG. 2, sideplate 30 and sideplate 35 are attached to frame 40 to form a carriage that supports front end equipment for a forklift truck. Frame 40 comprises a top horizontal crossbar 45 and a lower horizontal crossbar 50 that are connected by a left a vertical crossbar 55 a right vertical crossbar 60. Each of the sideplates 30, 35 are secured to the top horizontal crossbar 45 and to the lower horizontal crossbar 50.

Each of the sideplates 30, 35 carries a plurality of guides, such as rollers 65, that facilitate moving the frame 40 in a vertical direction with respect to mast rails 70 and 75. Each sideplate 30, 35 comprises a $1^{st}$ upper portion 80, 85, respectively, a $2^{nd}$ intermediate portion 90, 95, respectively, and a $3^{rd}$ lower portion 100, 105, respectively. The rollers 65 are attached to the upper portions 80, 85 and to the lower portions 100, 105 of the sideplates 30 and 35.

Each roller 65 fits within a vertical channel 110 of mast rails 70 and 75. The upper portions 80, 85 of the sideplates 30 and 35 are shaped and constructed such that when the rollers 65 are within the mast channels 110 the upper portions 80 and 85 are held externally of the mast channels 110. Likewise, the lower portions 100, 105 of the sideplates 30 and 35 are shaped and constructed such that when the rollers 65 are within the mast channels 110 the lower portions 100 and 105 are held externally of the mast channels 110. However, the intermediate portions 90 and 95 of the sideplates 30 and 35 are shaped and constructed such that when the rollers 65 are within the mast channels 110 the intermediate portions 90 and 95 are also within the mast channels 110.

Sideplates 30 and 35 are shaped and constructed such that when the rollers 65 are within the mast channels 110 a distance "d" between an interior surface 115 of upper portion 80 and an interior surface 120 of upper portion 85 is less than a distance "D" between an interior surface 125 of intermediate portion 90 and an interior surface 130 of intermediate portion 95. Optionally, a distance "dd" between interior surfaces of lower portions 100, 105 may be greater than distance "d", equal to distance "d", or less than distance "d". Optionally, an exterior surface 135 of intermediate portion 90 does not contact the back wall 140 of mast rails 70 and an exterior surface 145 of intermediate portion 95 does not contact the back wall 150 of mast rails 75 when the rollers 65 are within mast channels 110. Optionally, a wear plate, rubbing strep, dry lubricant, or wet lubricant may be included if there is contact between exterior surface 135 and back wall 140, or between exterior surface 145 and back wall 150.

A width "w" of the intermediate portions 90 and 95 is less than a width "W" of the mast channels 110. Optionally, the interior surface 125 of intermediate portion 90 and the interior surface 130 of intermediate portion 95 are contained within each of the mast channels 110 such that when the rollers 65 are contained within the mast channels 110 the operator of a fork lift truck cannot see the interior surfaces 125 and 130 because they are blocked from view by the rear wall 155 of the mast channel 70 and by the rear wall 160 of the mast channel 75. Thus, all or substantially all of the intermediate portions 90 and 95 are hidden from the view of an operator when an operator is located in the operator compartment of a fork lift truck.

Optionally, the upper portions 80 and 85 and the lower portions 100 and 105 may have a width that is equal to, less than, or greater than the width "w".

Optionally, the intermediate portion 90 is considered to be within mast channel 110 when no part of intermediate portion 90 breaks a plane 72 formed by an inner edge 165 of the front wall 170 and an inner edge 175 of the rear wall 155 of mast channel 70. However, transition portions 92 of the intermediate portion 90 that connect the intermediate portion 90 to the upper portion 80 and the lower portion 100 of the sideplate 30 will break the plane 72. Likewise, and optionally, the intermediate portion 95 is considered to be within mast channel 110 when no part of intermediate portion 95 breaks a plane 77 formed by an inner edge 185 of the front wall 190 and an inner edge 195 of the rear wall 160 of mast channel 75. Likewise, transition portions 97 of the intermediate portion 95 that connect the intermediate portion 95 to the upper portion 85 and the lower portion 105 of the sideplate 35 will break the plane 77. In other embodiments, portions of, or all of, the interior surfaces 125 and 130 may break the plane 72 and 77, respectively, preferably whilst maintaining "D" as a larger distance than "d".

The foregoing is a detailed description of illustrative embodiments of the invention using specific terms and expressions. Various modifications and additions can be made without departing from the spirit and scope thereof. Therefore, the invention is not limited by the above terms and expressions, and the invention is not limited to the exact construction and operation shown and described. On the contrary, many variations and embodiments are possible and fall within the scope of the invention which is defined only by the claims that follow.

The invention claimed is:

1. A carriage for a forklift truck comprising:

a frame;

a first sideplate secured to the frame, the first sideplate comprising an interior surface and an exterior surface opposite the interior surface, an upper portion, an intermediate portion, and a lower portion with a guide attached to the exterior surface of the upper portion and a guide attached to the exterior surface of the lower portion; and a second sideplate secured to the frame, the second sideplate comprising an interior surface and an exterior surface opposite the interior surface, an upper portion, an intermediate portion, and a lower portion with a guide attached to the exterior surface of the upper portion and a guide attached to the exterior surface of the lower portion;

wherein the first and second sideplates are constructed and shaped such that when the first and second sideplates are secured to the frame a first distance between the interior surfaces of the intermediate portions of the first and second sideplates is greater than a second distance between the interior surfaces of the upper portions of the first and second sideplates;

wherein the first and second sideplates are constructed and shaped such that when the guides attached to the upper portions and lower portions of the first and second sideplates are located within vertical channels of a mast (i) the upper portions of the first and second sideplates are outside such vertical channels of a mast, (ii) the intermediate portions of the first and second sideplates are within such vertical channels of a mast, and (iii) the lower portions of the first and second sideplates are outside such vertical channels of a mast.

2. A carriage for a forklift truck according to claim 1, wherein the guides comprise rollers.

3. A carriage for a forklift truck according to claim 1, wherein:

a width of the intermediate portion of the first sideplate is less than a width of a channel of a mast that is configured to bear the carriage; and a width of the intermediate portion of the second sideplate is less than a width of another channel of the mast that is configured to bear the carriage.

4. A carriage for a forklift truck according to claim 1, wherein:

the first and second sideplates are constructed and shaped such that when the first and second sideplates are secured to the frame the first distance between the intermediate portions of the first and second sideplates is greater than a third distance between the lower portions of the first and second sideplates.

5. A carriage for a forklift truck according to claim 4, wherein:

the second distance and the third distance are equal.

* * * * *